US006575855B1

(12) United States Patent
Buzak et al.

(10) Patent No.: US 6,575,855 B1
(45) Date of Patent: Jun. 10, 2003

(54) DAY AND NIGHT CROQUET AND BOCCE

(75) Inventors: Thomas S. Buzak, Beaverton, OR (US); Kevin J. Ilcisin, Beaverton, OR (US)

(73) Assignee: Technical Visions, Inc., Beaverton, OR (US)

( * ) Notice: Subject to any disclaimer, the term of this patent is extended or adjusted under 35 U.S.C. 154(b) by 205 days.

(21) Appl. No.: 09/586,448

(22) Filed: Jun. 2, 2000

Related U.S. Application Data

(60) Provisional application No. 60/175,120, filed on Jan. 6, 2000.

(51) Int. Cl.[7] ..... A63B 43/06; A63H 33/26

(52) U.S. Cl. ..... 473/569; 473/570; 473/594; 446/438; 273/DIG. 8; 362/190

(58) Field of Search ..... 273/DIG. 20, DIG. 24; 473/569, 570, 594, 595

(56) References Cited

U.S. PATENT DOCUMENTS 3,229,976 A * 1/1966 Allen, Jr. ..... 362/158
3,304,651 A * 2/1967 Deyerl ..... 200/61.47
4,448,418 A * 5/1984 McNeill ..... 273/123 A
4,878,674 A * 11/1989 Newcomb et al. ..... 473/200
4,930,776 A 6/1990 Newcomb et al.
4,957,297 A * 9/1990 Newcomb et al. ..... 473/200
4,963,117 A * 10/1990 Gualdoni ..... 446/219
5,054,778 A * 10/1991 Maleyko ..... 273/DIG. 8
5,080,359 A 1/1992 Thill
5,370,390 A * 12/1994 Swanson ..... 273/DIG. 24
5,403,000 A 4/1995 Woosley
5,595,388 A 1/1997 Swigart
5,607,226 A 3/1997 Toth et al.
5,611,720 A 3/1997 Vandermaas
5,683,316 A * 11/1997 Campbell ..... 273/DIG. 24
5,882,239 A * 3/1999 Trichak ..... 446/219
6,428,432 B1 * 8/2002 Kachel ..... 473/570

* cited by examiner

*Primary Examiner*—Paul T. Sewell
*Assistant Examiner*—Nini F. Legesse
(74) *Attorney, Agent, or Firm*—ipsolon llp

(57) ABSTRACT

Chemoluminescent illuminators are used in night visible game equipment, notably, croquet and bocce. Game balls overcome rotational wobble tendencies resulting from perturbations in the rotational moments of inertia. The balls are at least partially transparent or translucent and include a receptacle for receiving a chemoluminescent illuminator. Different colored illuminators are provided to mark different balls as relating to different players. In one embodiment the balls have relatively thin outer walls and internal metallic rings to contribute a majority of the necessary weight and to add differential weighting to equalize the moments of inertia around all three axes. Wickets comprise chemoluminescent illuminators held in proximity to conventional wickets. Wicket holders may assist with supporting the illuminators. Stakes and mallets accept chemoluminescent illuminators to illuminate the stakes.

25 Claims, 7 Drawing Sheets

Fig. 2
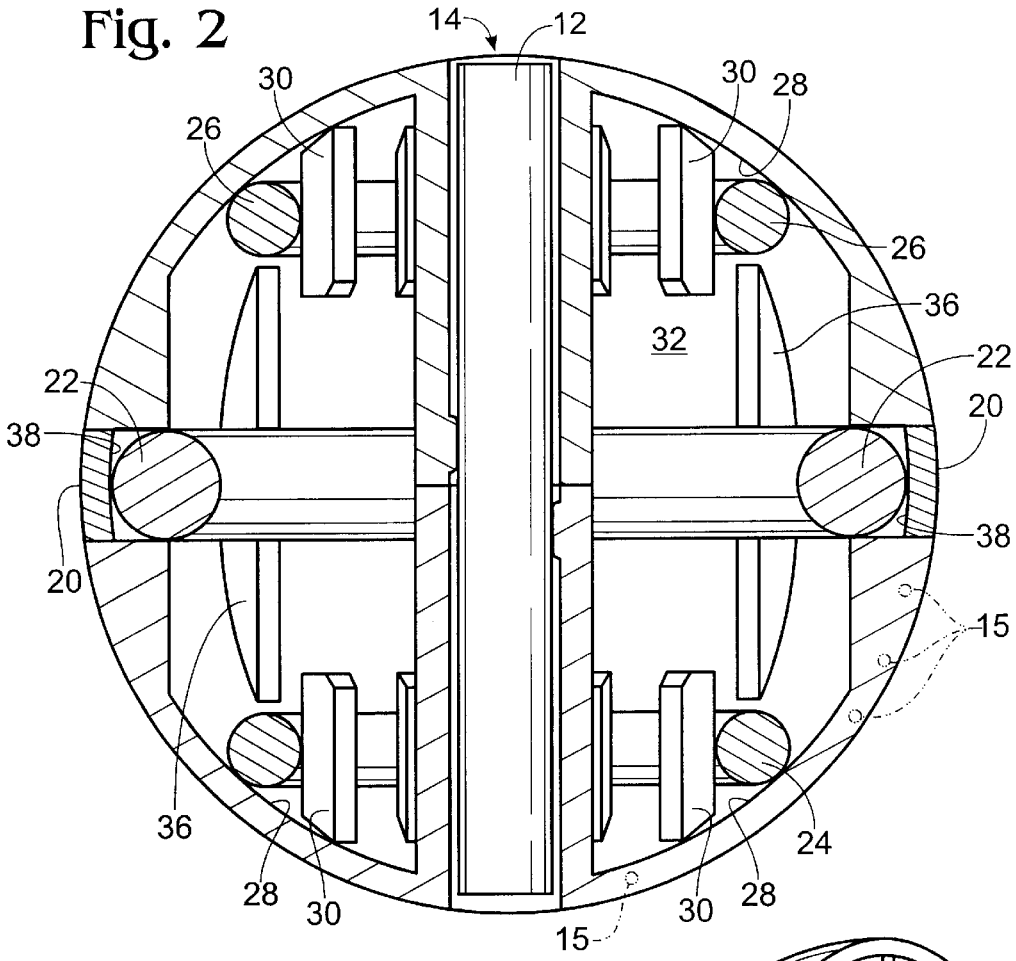
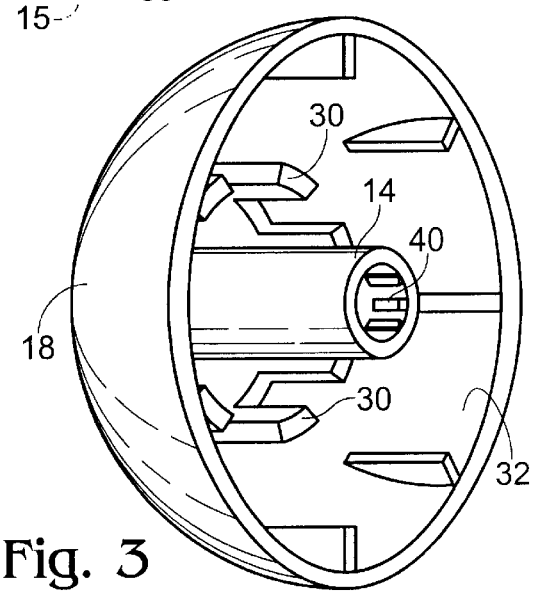
Fig. 3

Fig. 8
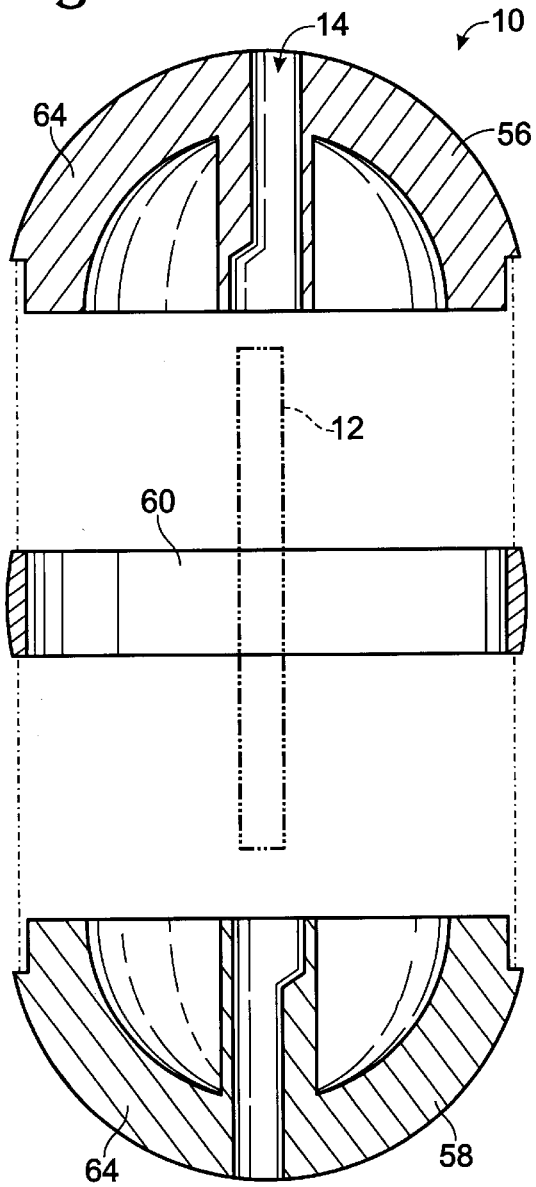
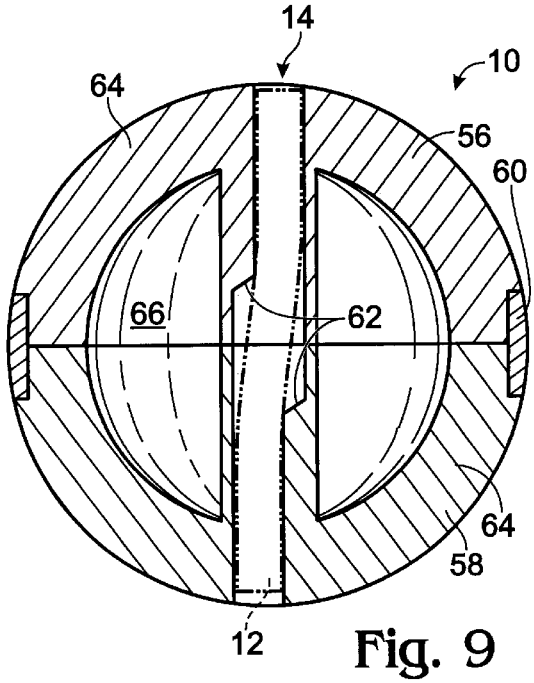
Fig. 9

Fig. 10
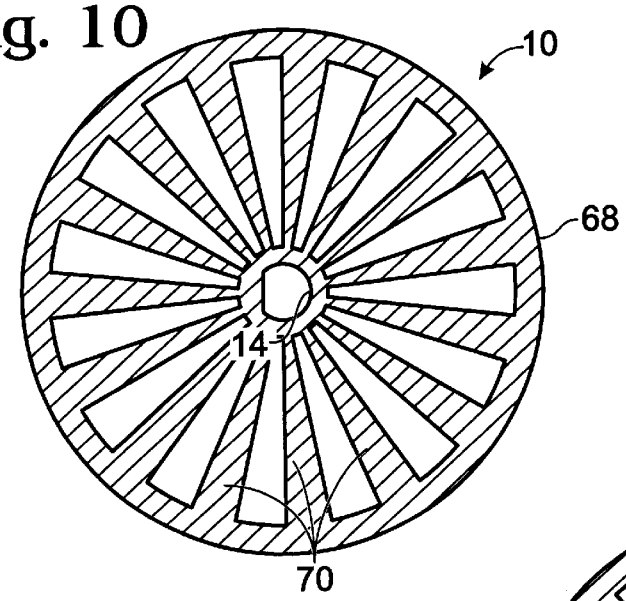
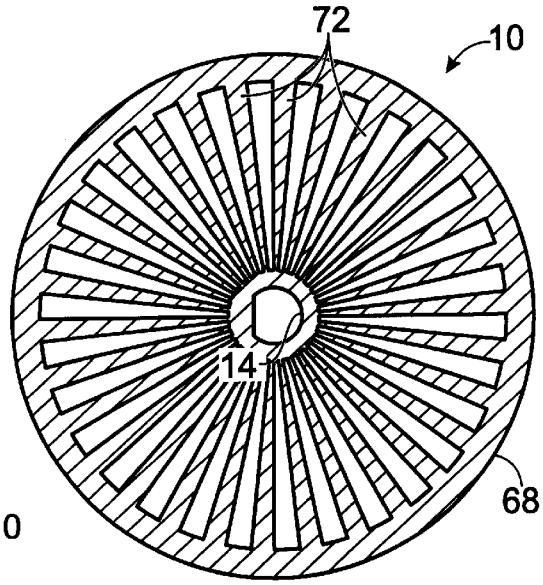
Fig. 11
Fig. 12
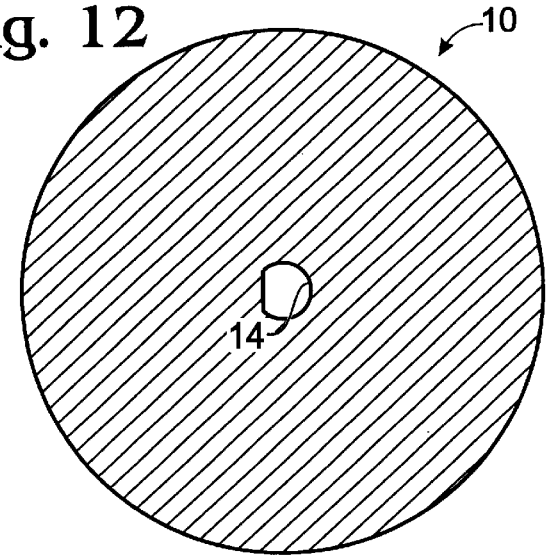

DAY AND NIGHT CROQUET AND BOCCE

This application claims the benefit of Provisional Application No. 60/175,120, filed Jan. 6, 2000.

FIELD OF THE INVENTION

This invention relates to games and game equipment. More specifically, the invention relates to the games of croquet and bocce (lawn bowling), and to equipment for use in these games that allows play in either light or dark conditions.

BACKGROUND OF THE INVENTION

Croquet and bocce are popular games that are enjoyed by many players. Briefly described, croquet play requires that a series of hoops or wickets are inserted into a playing surface, such as a lawn, to provide gates through which the croquet balls must pass in order for an individual player to advance his position in the game. Each player, in turn, strikes his or her croquet ball with a mallet to drive the ball in a specific order through the wickets. One goal of the game is to be the first to progress through the course of wickets.

Bocce, which is often called lawn bowling, is played on a court divided by a centerline. Play is begun by one team tossing a relatively small marker ball, sometimes called a "pallino", to act as a target for subsequent play. Each team then rolls their bocce balls in alternating turns (typically a total of eight balls, four for each of two teams) toward the pallino, with the goal being to roll the balls such that they are closer to the pallino than the opposing team's balls. Play continues until all balls have been thrown—the team with the balls closest to the pallino is awarded points. The team that wins one frame begins the next frame by again throwing the pallino.

Bocce is a very different game from croquet. But like croquet, bocce requires the use of balls, and the game is best suited to outdoor play on a surface such as a lawn. While specialized bocce balls are available from many different sources, croquet balls work well as bocce balls and many players use the same balls for both games.

Both croquet and bocce are typically played during daylight hours since during dark periods it is difficult to see the playing equipment. Nonetheless, many players would like to continue play after dark if they could. Absent an externally lighted court, which would be expensive to build and maintain and therefore not a possibility for most players, play after dark is either not possible, or at least very difficult. The limitations imposed by darkness are of course common to many games, and various solutions have been developed. However, none of the known equipment that has been developed for the play of games after dark is suitably modified for use with the equipment used in croquet and bocce.

One solution to the problems associated with the play of games at night is to use LEDs to illuminate game equipment. Vandermaas in U.S. Pat. No. 5,611,720 and Toth et al. in U.S. Pat. No. 5,607,226 describe a means for making sports equipment useable after dark by embedding LEDs into the devices. Vandermass' patent discloses a flying disk toy that has a plurality of LEDs arranged around a raised center section. A fairly complicated switching mechanism, activated by rotational movement of the disk to intermittently open and close the electrical circuit, intermittently illuminates the LEDs to cause a rapid flashing effect. Toth et al. describes street hockey equipment that is illuminated by LEDs contained in the equipment (i.e., the stick, puck and goal posts). But wherever LEDs are used, the equipment requires the use of batteries to provide a source of electrical current to illuminate the LEDs. This is not desirable because the batteries need to be replaced, and fresh batteries may not be readily available when they are needed. Finally, the Vandermaas and Toth et al. inventions require electronic circuits that may not be well suited to strong, repeated mechanical shock, although a hockey stick and puck certainly would be exposed to such shock.

Swigert in U.S. Pat. No. 5,595,388 describes a dark court game apparatus that utilizes equipment that is modified to reflect the light provided by illumination sources on the perimeter or bottom of the game area. Such inventions are not suitable for use outdoors or away from sources of power for the illumination. In addition, significant preparation of the court is required prior to use, which limits the ease of use.

Other prior art relies upon chemical illuminants to modify game equipment for use during the night. For instance, Newcomb et al, in U.S. Pat. No. 4,930,776 describes a technique for inserting a chemical illuminant into a translucent, thin walled ball that is required to have many holes on the surface. The "light stick" is formed into a circular ring, thereby activating the chemoluminescent chemicals contained in the stick. The ring is then inserted into the ball through one of the holes on the surface. Such a design is not suitable for sports such as croquet or bocce, both of which require the ball to be reasonably heavy in comparison to the described Wiffle® ball. Moreover, in the disclosed ball the light stick defines an equatorial member that has a mass extending around the ball's equator, just inwardly of the relatively thin outer wall. This structure results in a ball having unequal equal rotational moments of inertia around different axes, which in turn will cause the ball to wobble as it is rolled across a surface. While such uneven rotational movement may be desirable, or at least acceptable in a lightweight Wiffle® ball, it is unacceptable in a croquet and bocce ball.

Similarly, Thill, in U.S. Pat. No. 5,080,359, describes another thin shelled ball which includes doors fabricated into the surface of the ball with living hinges to allow insertion of the chemoluminescent device into the hollow cavity of the ball. The ball disclosed by Thill suffers the same rotational movement problems as the Newcomb et al. ball described above. Moreover, Thill's combination of a thin-shelled ball having hinged doors make the balls unsuitable for use in croquet or bocce.

Woosley in U.S. Pat. No. 5,403,000 describes yet another variant of a ball game that utilizes chemoluminescent devices to illuminate the equipment. Like Newcomb et al. and Thill, Woosley's ball has a relatively thin skin, and in this case is inflatable, as in the case of a basketball. The nominally opaque ball includes selected areas that are of reduced thickness and which are translucent or transparent (for instance, the seams on a basketball). A chemoluminescent capsule is inserted into a transparent or translucent housing attached to the shell of the ball. Light from the capsule is visible through the thinned seams. As with the balls described above, the Woosley ball results in the destruction of the degeneracy of the moment of inertia since the ball will have three very different moments of inertia. Not only would this ball thus have wobble problems when rolled, but the because the ball is relatively thin-skilled and inflated, it is not adaptable for croquet or bocce as the ball needs to be nominally heavy and translucent for excellent visibility at night. Woosley also describes using illuminants attached to standard basketball hoops or nets with removable clips to allow for night play. Such removable clips are not suitable for use with a croquet wicket because they could be knocked off the wicket and lost in the lawn. The clips could eventually be picked up by a lawnmower and destroyed and possibly turning into a dangerous projectile.

Finally, a known product is being sold using batteries and LEDs to illuminate bocce balls. This product is called Skizzo and is produced by Knight Sports of 508 S. Wilson St., Kennewick, Wash. 99336. This product is for lawn bowling games only, and not croquet. The balls reportedly weigh about 6.2 ounces with batteries and are slightly weighted on one side. Being differentially weighted on one side, these Skizzo balls plainly suffer from the uneven rotational movement described above, though the manufacturers of the product tout this as a means of creating more of a challenge to players. In addition, this product has the disadvantages of the need for batteries, the relatively light weight of the balls, and electronics that may be broken with severe mechanical shock.

There is a need, therefore, for equipment designed for use in the games of croquet and bocce that address the problems found in the prior art.

SUMMARY OF THE INVENTION

The present invention uses commercially available chemoluminescent light sticks and necklaces as illuminants to illuminate the balls used in lawn games such as bocce, as well as croquet. In a preferred embodiment the invention comprises a ball structurally designed to overcome the rotational dynamics problems associated with the prior art when chemoluminescent light sticks are incorporated into the ball. As such, the ball demonstrates negligible wobble when rolled and the presence of the light stick does not interfere with or change the dynamics of play. Moreover, the inventive ball is designed to be heavier to facilitate croquet and bocce play. In one embodiment the ball utilizes a relatively thin yet impact resistant outer wall and includes weighting material in the hollow interior to both add weight and to correct for rotational irregularities resulting from inclusion of a light stick in the ball. The relatively thin outer wall allows for good light transmission and the interior weighting is designed to provide good rolling characteristics and mass. For the best transmission of light, a major percentage of the ball's surface is translucent or transparent, although the balls demonstrate adequate visibility even when a relatively lower percentage of the surface area is translucent or transparent. In a second embodiment the ball features a relatively thicker outer wall in which weight distribution in the outer shell dominates moments of inertia perturbations resulting from molded design constraints and the presence of an asymmetric light stick.

The present invention also is embodied in wickets adapted for use with chemoluminscent necklaces for use at night, and which may also be used during daylight. Stakes and mallets that are used in the play of croquet are adapted for enhancing play of croquet during dark hours.

BRIEF DESCRIPTION OF THE DRAWINGS

The invention will be better understood, and the numerous objects and advantages of the invention will be apparent by reference to the following detailed description of the invention when taken in conjunction with the following drawings.

FIG. 2 is a cross sectional view of the game ball shown in FIG. 1, shown in an assembled state and taken along the line 2—2 of FIG. 1.

FIG. 3 is a perspective view of one hemispherical section of the game ball of FIG. 1.

FIG. 8 is an exploded cross sectional view of a first embodiment of a thick-walled game ball embodying the principles of the present invention.

FIG. 9 is a cross sectional view of the assembled hemispherical sections of the game ball shown in FIG. 8.

FIG. 10 is cross sectional view of a second embodiment of a relatively thick-walled game ball according to the present invention.

FIG. 11 is cross sectional view of a third embodiment of a relatively thick-walled game ball according to the present invention.

FIG. 12 is a cross sectional view of a solid core game ball according to the present invention.

DETAILED DESCRIPTION OF PREFERRED EMBODIMENTS

The following detailed description of various embodiments is made with respect primarily to croquet and the equipment used in the game. It will be appreciated that because all of the features described for croquet carry over to equipment used in lawn bowling games such as bocce, the invention is not limited to croquet.

In this invention, commercially available chemoluminescent illuminators (available from companies such as Omniglow Corporation, 96 Windsor Street, West Springfield, Mass. [www.omniglow.com]) are used in novel ways to illuminate uniquely designed balls, wickets, stakes and mallets, and to provide a novel means for providing equipment for use in night or day time (i.e., dark or light) conditions. Equivalent chemoluminescent illuminators acceptable for use in connection with the present invention are available from a variety of other sources. Generally described, the light sticks are hollow, pliable plastic rods that are available in various lengths. Sealed inside, the rods are two or more liquids. At least one of the liquids is further sealed in a breakable ampule or ampules (such as glass) that keeps the liquids separated until illumination is desired. Bending the rod breaks the internally contained glass ampule allowing the previously separated liquids to intermix. When the liquids mix, a chemical reaction is initiated that releases light. An observer can see the light that passes through the plastic rod. The color of the perceived light from the chemoluminescent sticks may be varied by inclusion of various chemicals in the liquids. For purposes of this invention, the standard colors for croquet balls are blue, red, black, yellow, green, and orange. With the exception of black, all of these colors are available in light sticks. Since black cannot be used as an illuminant color for nighttime play, it must be replaced with another color such as purple.

The manner of playing croquet and bocce with the present invention does not vary from the well-known rules of play, except that the invention allows the games to be played in the dark. The invention will be described therefore with reference to the pieces of equipment that are used in the game. For croquet, that equipment includes balls, wickets, stakes and mallets. Bocce only requires the use of balls, and it will be understood that the croquet balls described below are well suited for bocce. Bocce also requires the use of a relatively smaller pallino. The principles of this invention are not limited to balls of any particular size, and the principles described below with reference to a croquet or bocce ball apply equally to the smaller pallino, or to regulation bocce balls whose diameter is somewhat larger than that of standard croquet balls.

Balls

Figure 1:
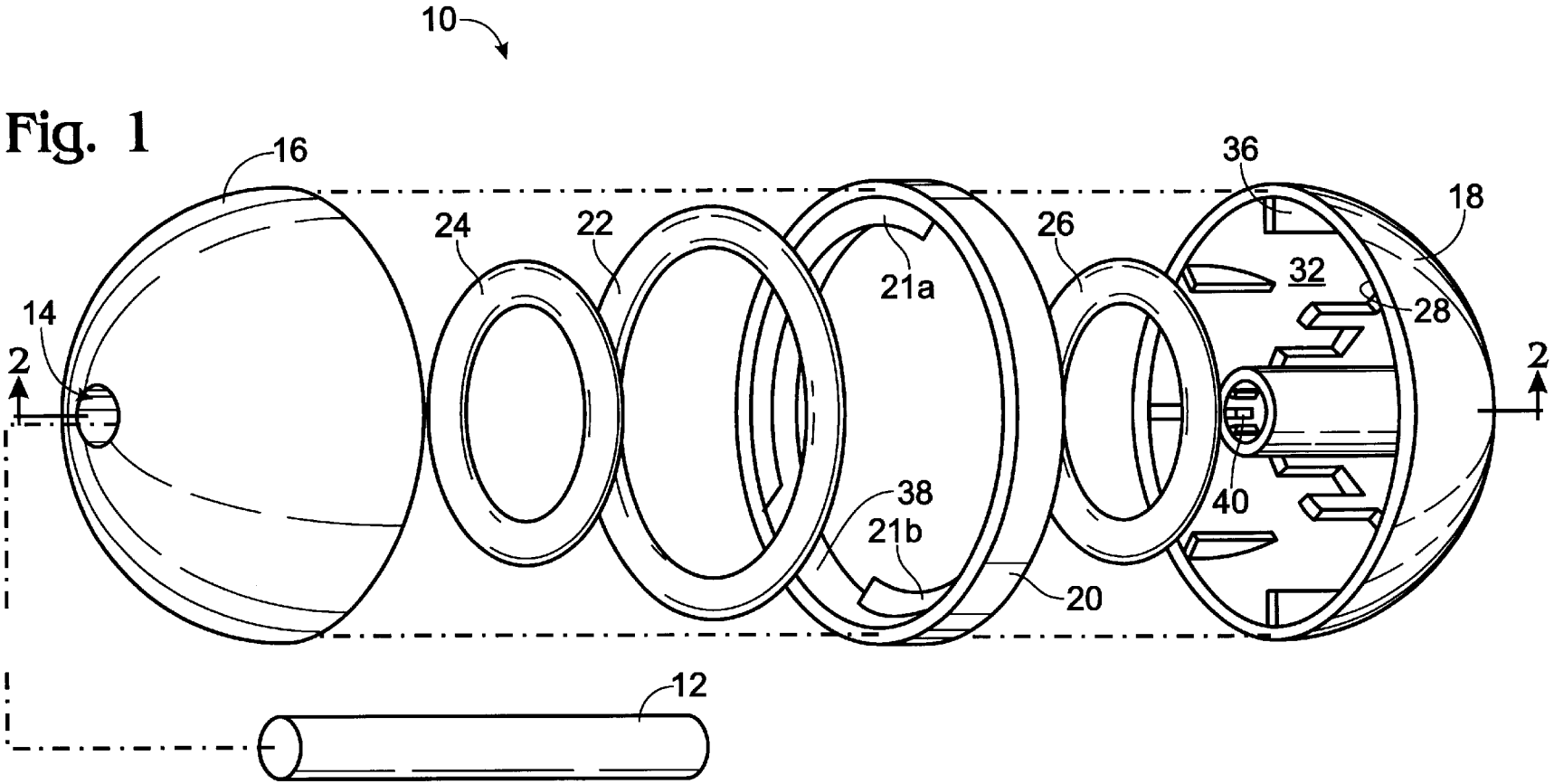
FIG. 1 is a perspective exploded view of a first preferred embodiment of a thin-walled game ball according to the present invention.

With reference to FIG. 1, a first embodiment of a croquet ball 10 according to the present invention is shown in an exploded perspective view. The design of ball 10 must simultaneously satisfy requirements for adequate weight, good impact resistance, low cost of fabrication, high perceived brightness, low material cost, and good balance. These design parameters are satisfied in preferred embodiment of a ball 10 that uses a combination of plastic and metallic parts. The plastic material provides good transparency, good structural strength, and low cost of fabrication. The metal parts satisfy the requirements, for high contrast, low material cost, and good balance. Before describing specific embodiments of ball 10, certain general attributes of the ball will be described.

In all cases the ball must have sufficient mass to be effective as a croquet (or bocce) ball. In both croquet and bocce, the balls collide with one another. Sometimes this is an unintended consequence of play, and sometimes collisions are intentional. Inflatable balls such as basketballs have a relatively lower mass to volume ratio as compared to a relatively more massive ball like a croquet ball.

Preferably, balls 10 are made of a transparent or translucent impact-resistant plastic or combination of plastics such as polycarbonate, ABS, K-resin, high impact polystyrene, cellulose acetate, cellulose acetate butyrate, cellulose acetate propionate, poly methyl methacrylate, polypropylene, polyvinyl chloride, acrynitrile, and butadiene. Standard injection molding techniques may be used to form the balls and/or the component parts. The inside and/or outside surfaces of the balls may be patterned to scatter light emitted by the contained light sticks. Adding scattering centers to the bulk of the plastic can enhance light scattering effect. Bulk scattering can be induced by adding glass beads or gas bubbles 15 to the plastic, a few of which are shown in FIG. 2, or by using naturally translucent plastics.

Given that collisions are inevitable, indeed intended, ball 10 must be impact resistant. The materials noted above provide adequate impact resistance assuming that the balls follow the structural specifications described herein.

It is a peculiarity of injected molded plastic materials that increased wall thickness can sometimes lead to decreased impact strength. The reasons for this decreased resistance to impact is often attributed to phenomena referred to as "molded-in stress." Molded-in stress results when the exterior surfaces of a thick-walled plastic part cools quicker than the interior, thereby setting up internal stresses as the interior material shrinks away from the hardened exterior surface. This shrinkage can also lead to cosmetic defects such as internal voids and sink marks on the surface. Given these practical molding constraints, a thick-walled ball is more difficult and more expensive to make relative to a thin-walled molded ball.

To compensate for the constraints described above and to provide for a ball that may be economically manufactured, in one embodiment described below, metal components are used to satisfy the weighting requirements of ball 10. In this case, the plastic wall thicknesses can remain relatively thin, optimizing impact strength and eliminating problems associated with thick walled parts, such as molded-in stress.

The balance of ball 10 is one important design parameters. In order for a ball to roll smoothly, the moments of inertia around any set of three orthogonal axes through the ball should be nearly equal. The design constraints described above imposed by molding requirements, together with the need for an asymmetrical light stick 12 extending through an axial sleeve 14 extending in or through the interior of the ball, can result in ball designs where it is difficult or impossible to make the moments of inertia equal about all axes extending through the center of mass. Thus, in a massive sphere that is translucent and which must roll with no appreciable wobble, it is necessary to consider mass distribution within the ball, and variations in that mass distribution resulting from an asymmetrical light stick held in the ball. While a solid ball will have good rotational dynamics, even when holding a light stick, molding processes dictate that solid balls remain in the molds for an extended period of time for cooling. This substantially increases cost. Moreover, even given adequate cooling times it is difficult to ensure proper curing of a massive, solid sphere or hemisphere.

Since the volume of a sphere is proportional to the cube of its radius, a disproportionate fraction of the mass of a ball is located in the large radiuses near the surface. This means that a thick-walled ball can be hollow and still retain a large fraction of the mass of a solid ball. Moreover, if this outer mass is distributed uniformly, the moment of inertia of the ball around all axes will be identical. Since the outer mass represents the majority of the mass of a hollow ball, it will dominate the rotational behavior of the ball, even when perturbed by a small asymmetrical mass near the center, such as a light stick.

As a practical matter, therefore, it is beneficial to design a molded ball such that its mass is concentrated near the surface, but which for practical reasons is not solid. When these principles are incorporated into a ball that must also be translucent, design criteria are made more difficult. Nonetheless, these principles are embodied in the present invention in several ball designs, each of which is described below.

Ball 10 shown in FIG. 1 is a preferred embodiment of a ball having relatively thin wall sections. The ball comprises first and second opposed hemispheres 16 and 18, respectively, which are joined with an equatorial band 20. Each hemisphere is substantially structurally identical to the other, although as noted below the hemispheres are azimuthally rotated 180° relative to one another when they are assembled. Hemispheres 16 and 18 are preferably entirely translucent or transparent plastic material, which allows transmission of colored light emitted from light stick 12. Although the word "translucent" is primarily used herein to describe the material from which balls 10 are fabricated, it will be appreciated that this convention applies transparent materials, as well as other materials capable of transmitting light. Equatorial band 20 is preferably colored, and may be either translucent to transmit light from light stick 12, or opaque. By coloring ring 20, balls 10 may be used for daytime play. Hemispheres 16 and 18 are interconnected with equatorial band 20 in any suitable manner to provide for sufficient impact strength. For instance, the parts may be connected by hot plate or sonic welding techniques, or alternately, with snap fit parts, threaded sections, or with an adhesive.

Alternately, hemispheres 16 and 18 may be fabricated from an opaque, colored plastic and equatorial band 20 may be made from a translucent material. Although the amount of light transmitted through a ball having this construction will be less than with the preferred design just described, the ball will have adequate light transmission for nighttime play.

Thus, balls 10 must be fabricated with at least some portion of the surface area comprising translucent material to allow for light to be emitted through the surface from the internal light stick.

As noted above, the weight and balance of the ball is important and the ball must have equal or nearly equal rotational moments of inertia in order to roll without wobble. In the ball shown in FIGS. 1 through 3, metal rings are used to provide weighting near the outer edges of the ball. The specific gravity of an inexpensive metal such as hard drawn steel wire is nearly eight times greater than that of most plastics, including the plastics identified above. This means that a small volume of metal can disproportionately contribute to the necessary substantial weight of croquet balls. This concentration of weight in the metal components of the ball has a positive effect on the rotational behavior of the ball.

Referring to FIG. 1, ball 10 includes three metallic rings having two different diameters. The rings are fitted and held within the hollow interior of the ball. In this design there is one equatorial ring 22 and two polar rings 24, 26. Polar rings 24 and 26 are held in hemispheres 16 and 18, respectively, along equal latitudes, and are coplanar with equatorial plane defined by equatorial ring 22. In the figures the equatorial ring is illustrated as having the same dimensional cross-sectional thickness as the polar rings. However, the thickness may vary between the polar and equatorial rings so long as overall balance of the ball is considered. Moreover, the particular metal used to make the rings is not specified because many different metal compositions may be used.

Polar rings 24 and 26 are held within the respective hemispheres in a circumferential seat 28 defined by a circumferential space between tabs 30 and the interior wall 32 of the hemisphere. As may be seen in FIGS. 2 and 3, tabs 30 extend inwardly from interior wall 32 generally toward the center of ball 10. Prior to the hemispheres being joined to form a sphere, the polar rings are positioned over tabs 30 and onto seat 28. Sonic or heat posting techniques are used to soften the plastic materials of tabs 30, deforming them outward and partially over the polar rings to hold them in place. Although during this process tabs 30 will be deformed somewhat, they are shown in the drawings in a non-deformed state. The rings are firmly held in place on seat 28 and are not loosened even with repeated mechanical shock.

Equatorial ring 22 is similarly held in place in ball 10 in a circumferential seat 34 defined between plural opposed, spaced apart ribs 36 in hemispheres 16 and 18, and the interior wall 38 of equatorial band 20. As best seen in FIG. 1, equatorial band 20 includes semi-hemispherical flanges 21*a* and 21*b* that extend inwardly toward the center of the spherical ball, from opposite edges of the ring to define a space therebetween for holding ring 22.

The rings are preferably metal wire that is formed into a circle as shown, but could just as well be cast or stamped metal.

Illumination of ball 10 is achieved by designing the ball to be transparent or translucent and inserting a Chemoluminescent light stick 12 into the ball in an axial sleeve 14 that extends through ball 10 along an axis generally transverse to the equatorial plane defined by equatorial ring 22. Axial sleeve 14 is a longitudinal tube that defines a receptacle configured to receive and retain light stick 12 within the tube so that the light stick does not become dislodged from the ball, even with repeated shock. However, the light sticks must be readily removable from the sleeve so they may be replaced when the luminescence is gone. In the embodiment shown FIGS. 1 through 3, axial sleeve 14 includes in each hemisphere (16, 18) interior ribs 40 that extend inwardly into the cylindrical sleeve. As noted above, the hemispheres are identical in structure. However, the hemispheres are rotated 180° relative to one another when assembled and interconnected. As may be seen, when the hemispheres are interconnected the two halves of axial sleeve 14 register such that they define tube through the ball. Rotation of the hemispheres relative to one another results in the ribs 40 in one hemisphere being spaced apart and diametrically opposed from the ribs 40 in the opposing hemisphere, resulting in a serpentine path through the tub defined through the ball. In practice the light stick is inserted into the tube. The diameter of the tube at ribs 40 is constricted relative to the other portions of the tube, and forces the light stick, which is a compliant plastic rod, into a serpentine path when inserted into the tube. Accordingly, light stick 12 when fully inserted into axial sleeve 14 is firmly held in place, but is readily removable and replaceable with a fresh light stick. Of course, ribs 40 may be formed in any convenient equivalent structure, such as a single, broader rib (as opposed to the two opposed groups of three relatively narrow ribs 40 shown in the drawing), to detail just one example.

Careful design of the light stick holder such as axial sleeve 14 near the center of the ball can improve the rotational symmetry of the ball. By choosing the correct ratio of a rod's length to its diameter it is possible to have rotational moments of inertia nearly equal for all axes. Moreover, a light stick can be held in place in a ball using a variety of structural designs different from but equivalent the ribs 40. As one example, an asymmetric hole though the ball could hold the light stick in place by using friction and the compliance of the cylindrical light stick. In addition, the ball could be separated into halves for insertion of the light stick, in which case the sleeve that holds the light stick could be closed to the outside of the ball on one or more ends of the longitudinal tube.

Chemoluminescent light sticks of a suitable size include light sticks that are approximately 75 mm in length and 7.5 mm in diameter. Unlike LEDs the light sticks are flexible, are available in all of the needed colors, and their light emitting properties are not affected by mechanical shock.

And while the present invention is described with reference to a light stick, it will be appreciated that chemoluminescent light sources are available in a variety of geometric configurations, and many such configurations are adequate sources of illumination material.

The use of the metal weights of rings 22, 24 and 26 illustrated in FIGS. 1 through 3 adds an additional degree of freedom that can compensate for design imbalances in the plastic part, as well as the rotational perturbations caused by light stick 12. This results in a well-balanced ball having a set of degenerate (nearly equal) moments of inertia. The three-ring design of FIGS. 1 through 3 is one such well-balanced design. The ring wire diameters, the ring diameters, and the location of the rings within the ball are all parameters that can be varied over large ranges of values to simultaneously provide the ball with the desired weight and balance. Ring shaped weights are particularly desirable because of their azimuthal symmetry, and because they are inexpensive to manufacture using standard metal forming processes.

Figure 4:
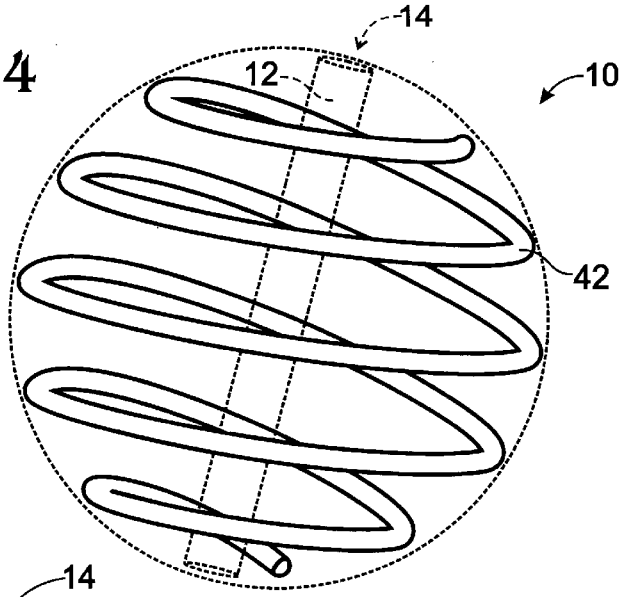
FIG. 4 is a side elevational view of a second embodiment of a thin-walled game ball according to the present invention, in which the ball'surfaces are shown in phantom lines to expose the interior of the ball.
Figure 5:
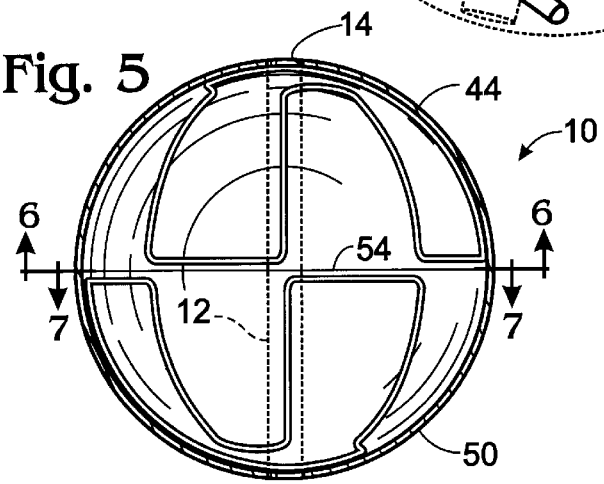
FIG. 5 is a side cross sectional elevational view of yet another embodiment of a thin-walled game ball according to the present invention.

However, there are many weight geometries that can lead to the required balance and weight values, and it will be obvious to someone skilled in the art of rotational dynamics that many additional designs are possible. Two alternate ball configurations that utilize metal weights to add mass to the balls and to correct for rotational perturbations caused by imbalances from the plastic molding techniques, and by the light stick, are shown in FIGS. 4 and 5. In FIG. 4 ball 10 includes a spirally wound metal band 42 that lies adjacent the interior surface of the ball. Axial sleeve 14 extends through ball 10 along an axis transverse to the equatorial plane defined by the spirally wound metal band.

Figure 6:
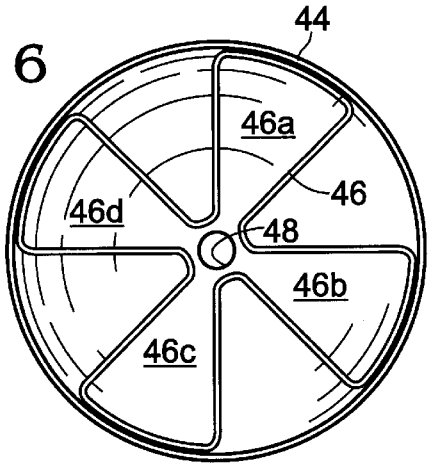
FIG. 6 is a cross sectional view of the first hemispherical section of the game ball shown in FIG. 5, taken along the line 6—6 of FIG. 5.
Figure 7:
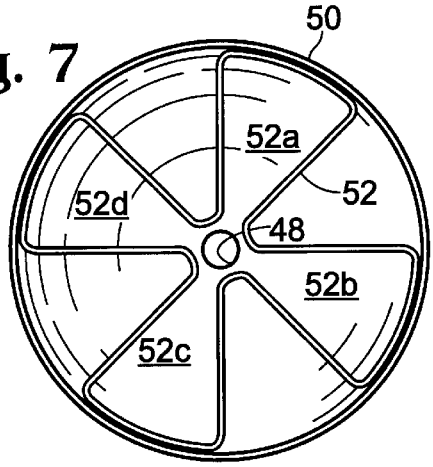
FIG. 7 is a cross sectional view of the second, opposite hemispherical section of the game ball shown in FIG. 5, taken along the line 7—7 of FIG. 5.

As a further example of a thin-walled ball 10 that relies upon metal for mass and balance, in FIGS. 5 through 7 the ball is shown as incorporating opposed hemispherical wire weights. Referring to FIG. 6, first hemisphere 44 contains a first weight 46, comprising a continuous length of wire formed into a hemispherical longitudinal and latitudinal path. As may be seen, the wire sections are hemispherically shaped when viewed in elevation (FIGS. 6 and 7) to conform to the radius of the interior wall of hemisphere 44. Referring again to FIG. 5, when ball 10 is assembled by joining hemispheres 44 and 50, the hemispheres are rotated relative to one another such that the geometric shapes of weight 46 are staggered or offset from the geometric shapes of weight 52. The wall material between holding the weights comprises translucent plastic through which light is transmitted. The hemispheres are joined such that the axial sleeve 14 for receiving light stick 12 extends along an axis transverse to the equatorial band between the two hemispheres.

The structural configurations illustrated in the embodiments of FIG. 4, and FIGS. 5 through 7 result in well-balanced thin-walled balls in which the moments of inertia around any three axes are essentially identical. A relatively thin-walled ball is preferred for a variety of functional reasons. For example, utilizing thin wall sections in plastic parts minimizes the cost of fabrication. Most of the time that a plastic part spends in a molding machine is the part cooling time after the plastic has been injected into the mold. The part must cool before removal from the mold in order to maintain its molded shape. Thin wall parts cool more rapidly than thick wall parts, allowing for faster cycle times in the molding machine. Faster cycle times translate directly to lower fabrication costs.

Second, the perceived brightness of the ball is improved in thin walled balls. Perceived brightness is enhanced by two factors. The first of these is again related to thin wall sections in the plastic parts. Thin walls result in reduced light absorption as the light, emitted near the center of the ball transverses through the plastic material in the ball and to the observer. This enhanced transparency results in greater luminance and higher perceived brightness. A second factor that increases perceived brightness is the contrast provided by the opaque metal parts in the interior of the ball. By reflecting and absorbing some of the light, the dark appearance of the metal weights provides a strong contrast to the transparent portions of the ball, increasing the perceived brightness of the transparent areas.

Finally, the material cost per unit weight of inexpensive metals such as hard drawn steel is less than that of most plastic materials. Hence by including metal components inside the plastic balls to provide the majority of the weight of the balls, the ball cost is reduced when compared to an all-plastic ball of equal weight. The metal weights may be coated with materials such as zinc or paint, which allows adding color, reflectivity, or other visual effects that may further enhance the appearance of the ball.

Although a relatively thin walled ball is preferred for the reasons just noted, a ball having a relatively thicker wall is suitable for use with the present invention if it is manufactured adequately. Thus, yet another method for achieving a ball having the proper mass and nearly equal rotational moments of inertia around all axes is to make the outer shell of the ball as thick as possible.

Embodiments of balls 10 having relatively thicker outer shells are shown in FIGS. 8 through 12. As noted above, a disproportionate fraction of the mass of a ball is located in the large radiuses near the surface. As such, a thick-walled ball can be hollow and still retain a majority of the mass of a solid ball. Where the outer mass is distributed uniformly, the moment of inertia of the ball around all axes will be identical, or nearly so. Since the outer mass represents greater than 50 percent of the mass of a hollow ball, it will dominate the rotational behavior of the ball, even when perturbed by a small asymmetrical mass near the center, such as a light stick.

The embodiments shown in FIGS. 8 through 11 rely upon these geometric relationships to provide a ball having good rotational and rolling characteristics. With reference to FIG. 8, ball 10 is shown as a three-component ball comprising first hemisphere 56, second hemisphere 58 and equatorial band 60. As with prior embodiments, ball 10 includes an axial sleeve 14 for receiving a light stick (not shown). When the hemispheres are joined as shown in FIG. 9, the two halves of the axial sleeves register such that the sleeves communicate and define a light stick holding passageway through the ball. Moreover, the passageway includes diametrically opposed offset shoulders 62 that define a means for retaining light stick 12 in sleeve 14 in the manner described above with respect to FIGS. 1 through 3, and ribs 40. It will be readily apparent that the compliant light stick is retained in the serpentine path defined by shoulders 62 in sleeve 14, as figuratively illustrated in FIG. 9.

Ball 10 of FIGS. 8 and 9 has relatively thicker outer wall sections 64 and a hollow core 66. This thick-walled embodiment can be hollow and still retain a large fraction of the mass of a solid ball. Because the outer mass is distributed uniformly, the moment of inertia of the ball around all axes will be identical or nearly so, resulting in a wobble-free roll.

FIGS. 10 through 12 illustrate three additional possible configurations for thick-walled balls in which the moment of inertia of the ball around all axes will be degenerate. In FIG. 10 the wall 68 is joined to wall-section spokes 70 that extend radially outwardly from the wall of axial sleeve 14. A similar configuration is shown in FIG. 11 where the relative thickness of radially extending spokes 72 is less than spokes 70 of FIG. 10. In FIGS. 10 and 11 the spokes add mass to the ball, resulting in a well-balanced ball that does not wobble. Finally, in FIG. 12 the ball 10 is solid. In this case the ball could be formed in a unitary molding process, or could be formed hemispheres that are interconnected in any suitable manner as described above. With a solid ball, the sheer mass of the ball makes up for perturbations in the rotational dynamics caused by the light stick and by variations in mass distribution of the plastic material.

In view of the numerous embodiments of ball 10 described above it will be apparent that many equivalent configurations for an illuminated ball maybe built.

Wickets

Conventional croquet wickets are typically made of metal wire coated with a white paint or plastic material. Although they are often colored white, these conventional wickets become difficult or impossible to see in low light conditions, limiting play to daytime conditions. As such, to facilitate nighttime play, the present invention relies upon the light emitting properties of chemoluminescent illuminators to provide a glowing wicket as an adjunct to conventional wickets. A typical preferred chemoluminescent product suitable for use in connection with, this invention is a single or multicolor chemoluminescent "necklace," although the shorter light sticks described above also will function to illuminate the wickets. The necklaces are hollow plastic rods that are commercially available (for instance, from Omniglow Corp.), and which are preferably approximately 22 inches long. These necklaces have several properties that make them suitable for use with the present invention. Since they are straight in their initial non-luminous state, the chemoluminescent necklaces may be bundled, packaged, and shipped in a configuration taking up as little volume as possible. After bending and activation the chemoluminescent wickets glow for hours, providing time for many croquet games. The flexibility of the chemoluminescent necklace allows it to be easily and bent into the hoop shape of the wicket.

In the prior art patent to Woosley described above, clip-like retainers for holding chemoluminescent wands may be attached to and removed from holders such as a basketball rim. If removable clips such as those described by Woosley were used with conventional croquet wickets, the clips could be knocked off if a croquet ball of sufficient force struck the wicket. Not only is this inconvenient, resulting in the interruption of the game and potential loss of the retainer clips in the lawn during nighttime play, but the lost parts could also be eventually picked up by a lawnmower, destroying the part and possibly turning it into a dangerous projectile.

In a croquet set according to the present invention, it is desirable to have a set of conventional wickets as well as the wickets that allow for nighttime play. Although spent glow wickets as described below are also suitable for daytime play, it is desirable to have conventional wickets for first time play in daylight, so that the glowing feature of the glow wickets is not "wasted" in daylight.

Figure 13:
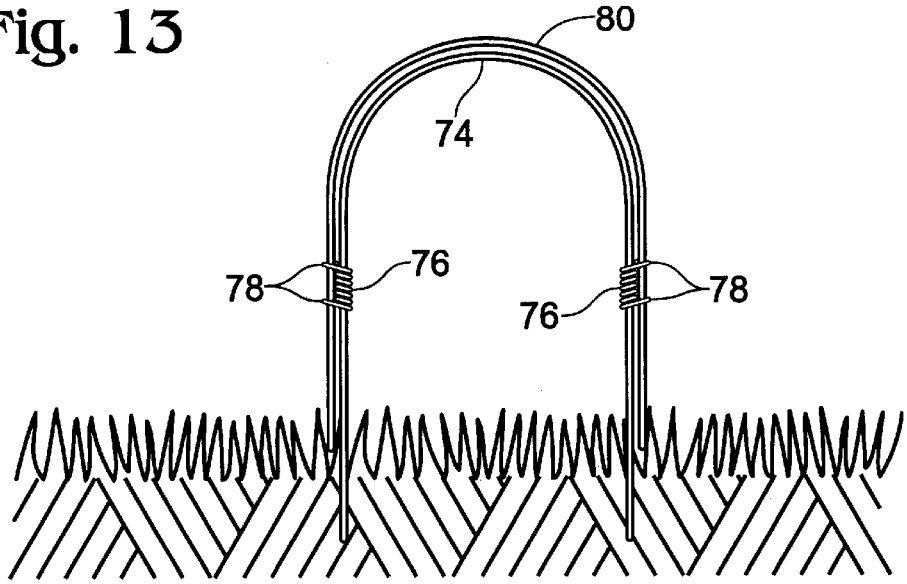
FIG. 13 is an elevational view of a first preferred embodiment of an illuminated wicket, showing the wicket inserted into the ground.
Figure 14:
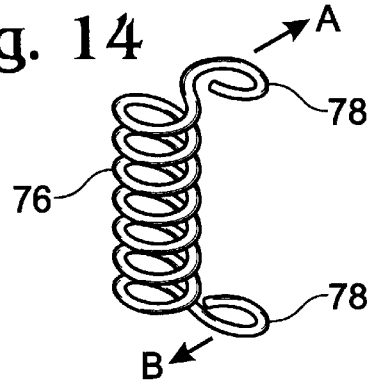
FIG. 14 is a perspective view of a torsional spring used in connection with the wicket shown in FIG. 13.

The present invention thus utilizes rather conventional wire wickets, and combines those wickets with novel features that solves the problems associated with the prior art. Referring now to FIG. 13, a conventional wicket 74 is shown as it used inserted into the ground. The glow-wicket holder of the present invention comprises a torsional spring 76 having two or more aligned exterior loops 78 to hold the necklace 80. The interior diameter of spring 76 when relaxed is somewhat smaller than the outer diameter of the wire used for wicket 74. As such, the springs grip wicket 74 securely when attached thereto. As in FIG. 13, exterior loops 78 retain necklace 80 in place on wicket 74. Since the necklace is bendable and conforms to the shape of the wicket when attached as shown in FIG. 13, the perceived nighttime effect is a lighted wicket. Loops 78 also are used as handles that allow the spring to be loosened and slipped onto the shafts of the conventional wickets. Referring to FIG. 14, this is easily accomplished by using the thumb and forefinger to azimuthally twist the spring such that the inner diameter through spring 76 is increased. This is done by pushing loops 78 in, the directions A and B as shown in the arrows in FIG. 14. In the resulting expanded state, spring 76 is easily slipped onto and off of each of the downwardly extending arms of the wicket 74. When released, the spring is reduced in diameter and is tightly held onto the arms of wicket 74.

The only way that spring 76 can be removed is by repeating the process of expanding the springs by pushing loops 78 in opposite directions, and then sliding the springs off of the wicket. Although this is an easy and natural task when done by hand, it is impossible for the impact of a ball to simultaneously create these forces. Thus torsional springs 76 will not unintentionally separate from wickets 74. There are accordingly no interruptions in play caused by the impacts of normal play, no loss of parts in the dark, and no lost or lose parts becoming projectiles during lawn mowing. In the preferred embodiment it is desirable that springs 76 be made of a corrosion resistant material such as zinc coated spring steel or stainless steel.

Figure 15:
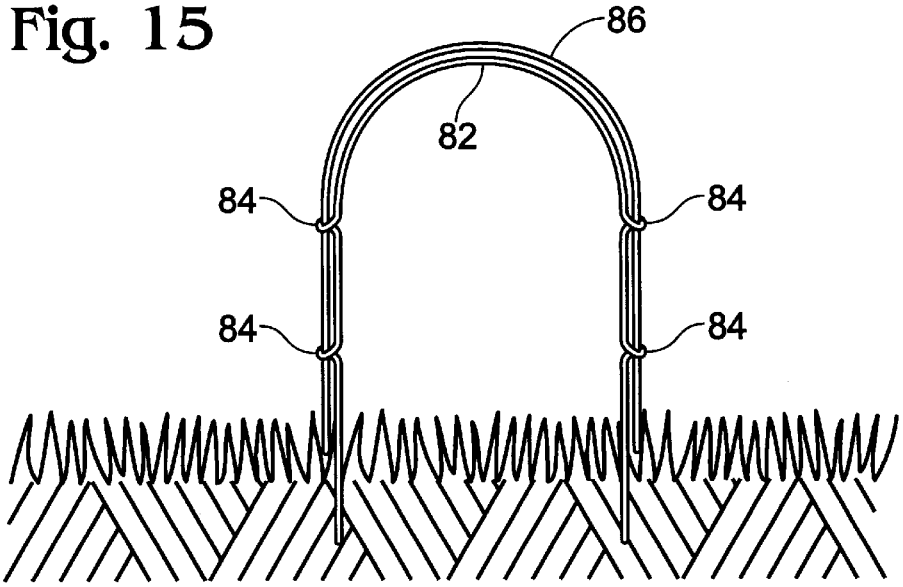
FIG. 15 is an elevational view of an alternative embodiment of an illuminated wicket, showing the wicket inserted into the ground.

Alternatives to torsional springs 76 that also solve some of the problems inherent in the prior art include the embodiment shown in FIG. 15. Wicket 82 in FIG. 15 is fabricated from standard wire and includes two or more loops 84 formed in each of the downwardly extending arms of the wicket. These loops retain a necklace 86. Moreover, yet another alternative would be a pair of receiving tube sections permanently attached (for instance, by welding) to the outer-facing side of the wickets. The tubes receive the ends of the necklace.

As an alternative to the approaches described above, which rely upon a standard wire wicket used in combination with a chemoluminescent necklace, the necklaces themselves may be utilized as the wickets. The strength and resilience of the necklaces allow them to maintain their shape after being struck by croquet balls. In fact, the chemoluminescent wickets are more apt to spring back to their original hoop shape after being struck by a ball than standard wire wickets. Even after the chemicals are spent and light is no longer emitted, the chemoluminescent wickets may be used as wickets for standard daytime play.

Figure 16:
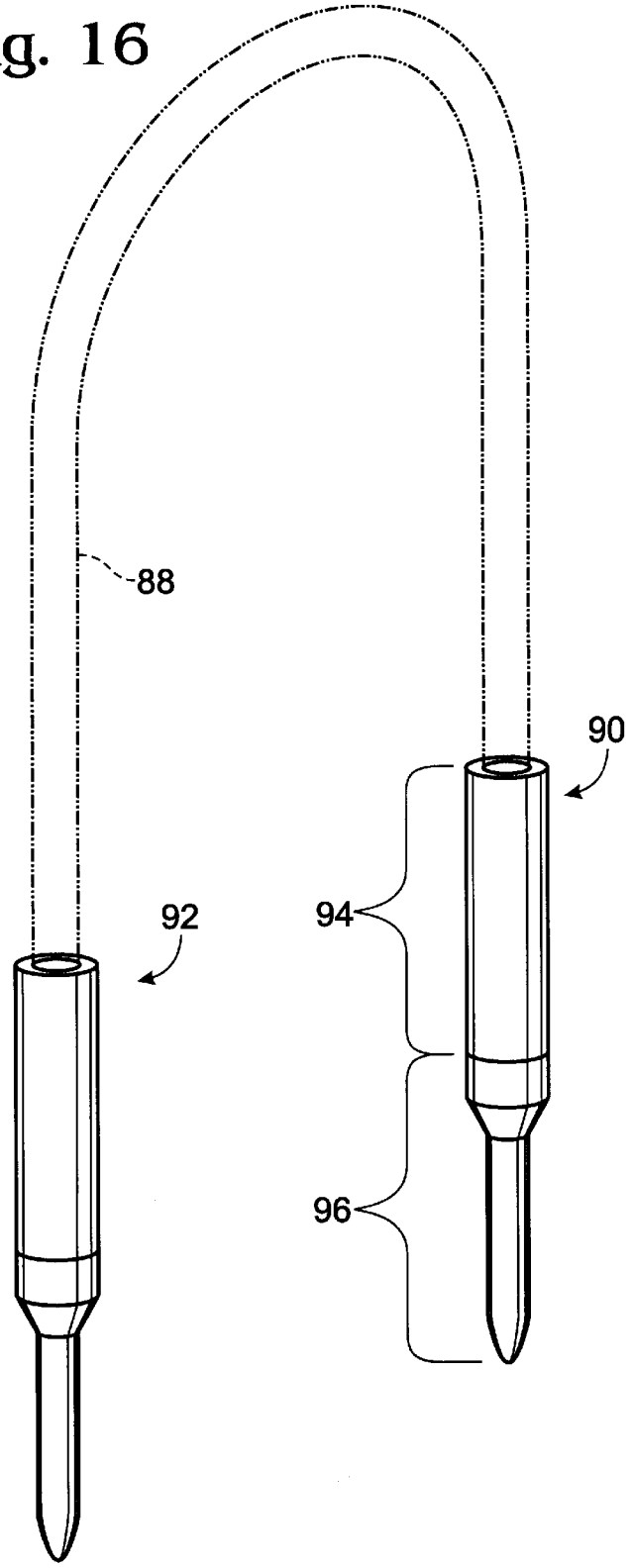
FIG. 16 is yet another alternate embodiment of an illuminated wicket for use in connection with the present invention.

Of course, while existing chemoluminescent necklaces provide a ready supply of chemoluminescent wickets, similarly designed chemoluminescent rods may be used that have design features that enhance the suitability for croquet use. One design enhancement would be to lengthen and taper the ends of the chemoluminescent wickets so they can be more easily inserted into the earth. Another method for holding the chemoluminescent wickets is illustrated in FIG. 16. In this embodiment opposite ends of chemoluminescent necklace 88 are inserted into a pair of identical wicket holders 90 and 92. With reference to wicket holder 90, the holder comprises an upper translucent tube 94 having an interior bore sized to receive necklace 88, and through which luminescence is transmitted. A tapered, pointed ground post 96 is connected to tube 94 for insertion into the ground. Post 96 is preferably brightly colored so that it may be readily found in the lawn, particularly if it is dark and necklace 88 has become separated from wicket holders 790 and 92. In addition, phosphorescent pigments may be added to the components of wicket holders 90 and 92. Zinc sulfide and strontium aluminate are two examples of phosphorescent pigments that can be incorporated into plastics or paints used in connection with wicket holders 90 and 92. The phosphorescent pigments are in close proximity to the light emitted by the chemoluminescent necklace 88, and so are continually being excited to emit light. If necklace 88 and wicket holders are separated during nighttime play, the wicket holders are easily located due to their phosphorescent glow. In order for this to be effective, it is important to use necklaces 88 that emit light with a wavelength shorter than the light emitted by the chemoluminescent pigments in wicket holders 90 and 92. Commercially available chemoluminescent necklace materials and phosphorescent pigment materials are available that satisfy the wavelength condition for adequate glow.

Stakes and Mallets

Figure 17:
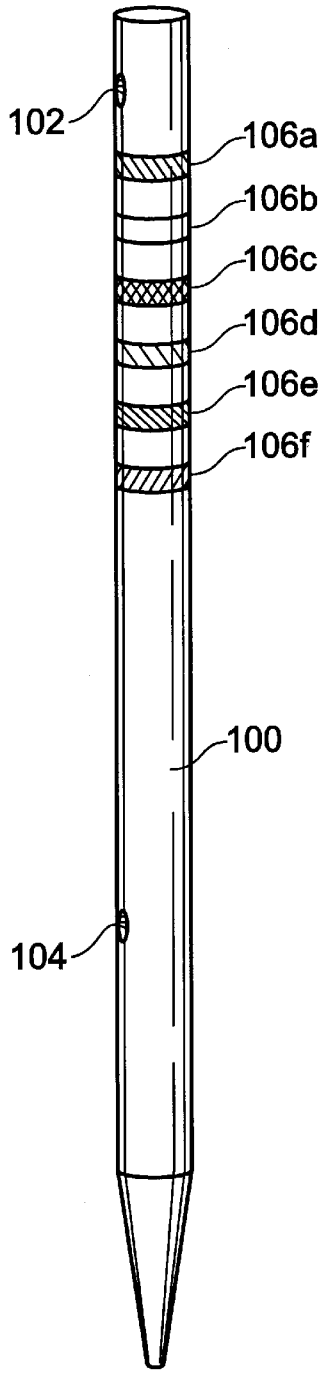
FIG. 17 is a perspective view of a croquet stake used in connection with this invention.

Referring to FIG. 17, the stakes 100—two of which are typically used in a game of croquet—are made more visible for nighttime play in several ways. The first is to use a bright or white material for the stake, or to paint the stake a bright color such as white. Since the stake is often located in close proximity to one or more wickets in standard croquet layouts, light from the chemoluminescent wicket is reflected by the stake, making it visible even in low-light conditions. Enhancements include attaching additional chemoluminescent devices to the stakes, or using phosphorescent pigments on the stake. One method of attaching a chemoluminescent device to the stake is form small holes 102 and 104 at the top and bottom, respectively, of the stake, perpendicular to the long axis of the stake. One end of a chemoluminescent necklace (not shown) can be inserted though top hole 102 and the necklace coiled around the stake with the opposite end of the necklace inserted through bottom hole 104. As is traditional with croquet stakes, certain identifying indicia such as color bands 106*a* through 106*f*, each of which represent a different color, encircle the stake.

Similar modifications may be made to the mallets (not shown).

While the present invention has been described in terms of the best mode of a preferred embodiment, it will be appreciated by one of ordinary skill that the spirit and scope of the invention is not limited to those embodiments, but extend to the various modifications and equivalents as defined in the appended claims.

We claim:

1. A game ball, comprising:

a spherical shell;

a receptacle formed in said shell for receiving a chemoluminescent light source;

weight means for adding mass to said ball, said weight means comprising an equatorial ring weight extending around an equator of said shell adjacent said interior shell surface, and a pair of circumferential polar ring weights spaced apart from said equatorial ring weight and extending around said interior shell surface at opposite poles of said sphere, whereby said weight means compensates for perturbations in the rotational moments of inertia of the ball.

2. The game ball of claim 1 wherein at least a portion of the surface area of said shell is translucent.

3. The game ball of claim 1 wherein a major portion of the surface area of said shell is translucent.

4. The game ball of claim 1 including a chemoluminescent light stick received in said receptacle.

5. The game ball of claim 1 wherein said receptacle comprises a longitudinal axial tube extending through said shell and opening to the outer shell surface on at least one end thereof.

6. The game ball of claim 5 wherein said spherical shell has a hollow core defined by an interior shell surface.

7. The game ball of claim 5 wherein said equatorial ring weight defines an equatorial plane and said axial tube extends through said sphere transverse to said equatorial plane.

8. The game ball of claim 7 wherein said polar weight rings lie in planes that are coplanar with said equatorial plane.

9. The game ball of claim 5 including a rib within said axial tube extending toward the axis thereof and configured for contacting a light stick received within said axial tube.

10. The game ball of claim 9 including plural ribs.

11. The game ball of claim 10 including diametrically opposed ribs within said axial tube defining a serpentine path through said axial tube.

12. The game ball of claim 1 wherein said shell comprises a first material and said weights comprise a second material that is different from said first material.

13. The game ball of claim 12 wherein said second material is of higher density than said first material.

14. The game ball of claim 1 in which said translucent spherical shell includes light scattering means for scattering light emitted by a light stick received within said receptacle.

15. The game ball of claim 14 in which said light scattering means comprise scattering centers contained within said shell.

16. The game ball of claim 15 in which said scattering centers include glass beads contained within said shell.

17. The game ball of claim 14 in which said light scattering means comprise bubbles contained within said shell.

18. The game ball of claim 1 including an equatorial band extending around an equator of said ball, said band being colored differently from said shell.

19. The game ball of claim 18 in which said band is translucent.

20. The game ball of claim 18 wherein said band is opaque.

21. A game ball, comprising:

a spherical shell having an outer shell surface and a hollow core defined by an inner shell surface, said shell formed of a first material and wherein at least a portion of said shell is translucent;

a receptacle in said shell for receiving a chemoluminescent light source;

a weight contained in said hollow core and formed of a second material that has a greater density than said first material, said weight comprising a first circumferential ring extending around an equator of said shell within the core, and second and third circumferential rings within the core and positioned on opposite sides of said first circumferential ring, and wherein said circumferential rings define coplanar ring planes.

22. The game ball of claim 21 wherein said weight is fixed within said hollow core adjacent said inner shell surface.

23. The game ball of claim 21 including a chemoluminescent light stick received in said receptacle.

24. The game ball of claim 23 wherein said receptacle comprises a tube extending through said shell and opening to the outer shell surface on at least one end thereof.

25. The game ball of claim 21 wherein said tube extends axially through said shell and each opposite end of said tube opens to said outer shell surface.

* * * * *